United States Patent [19]

Iseki

[11] 4,244,137

[45] Jan. 13, 1981

[54] TOY CAMERA HAVING PICTURE EJECTION MECHANISM

[75] Inventor: Takeo Iseki, Tokyo, Japan

[73] Assignee: Tomy Kogyo Co., Inc., Tokyo, Japan

[21] Appl. No.: 65,212

[22] Filed: Aug. 9, 1979

[30] Foreign Application Priority Data

Aug. 11, 1978 [JP] Japan ..... 53-110676

[51] Int. Cl.[3] ..... A63H 33/30

[52] U.S. Cl. ..... 46/39; 46/1 R

[58] Field of Search ..... 46/1 R, 39; 354/88; 156/DIG. 35, DIG. 50

[56] References Cited

U.S. PATENT DOCUMENTS

| | | | |
|---|---|---|---|
| 2,602,265 | 7/1952 | Jackson | 46/1 R X |
| 2,639,688 | 5/1953 | Procter | 156/DIG. 50 |
| 2,939,244 | 6/1960 | Grimes et al. | 46/1 R X |
| 3,090,158 | 5/1963 | Dixon | 46/1 R X |
| 3,262,418 | 7/1966 | Stephens et al. | 156/DIG. 50 |
| 3,283,684 | 11/1966 | Land | 354/88 X |

*Primary Examiner*—Gene Mancene
*Assistant Examiner*—Mickey Yu
*Attorney, Agent, or Firm*—K. H. Boswell; Edward D. O'Brian

[57] ABSTRACT

A toy camera having a housing shaped to depict a camera including a view finder, a lens, and a flash turret has an opening in the housing allowing ingress and egress into the interior of the housing. A plate representing a picture has a flat surface and is capable of fitting into the opening such that it can be inserted and retained in the housing. An ejection member is located in the housing in position to operatively interact with the plate when the plate is inserted in the housing such that upon activation by the operator of the toy the plate can be ejected from the housing. Also located within the housing is a braking member which is positioned to bear on the flat surface of the plate as the plate is ejected from the housing. The braking member effectively retards or slows down the ejection of the plate from the housing and concurrently deposits a thin film of fluid on the flat surface of the plate.

10 Claims, 7 Drawing Figures

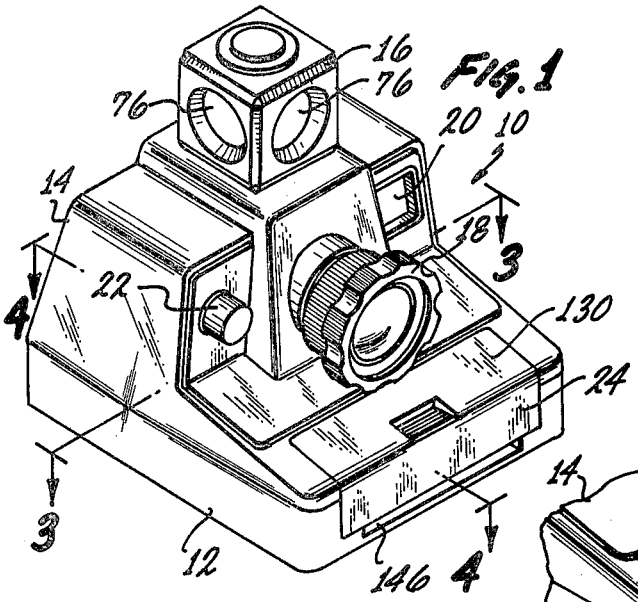
FIG. 1
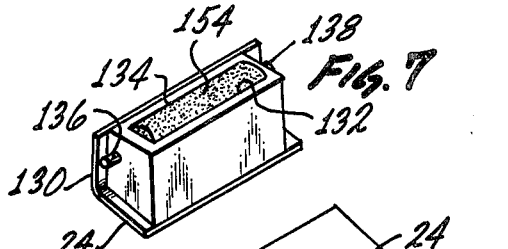
FIG. 7
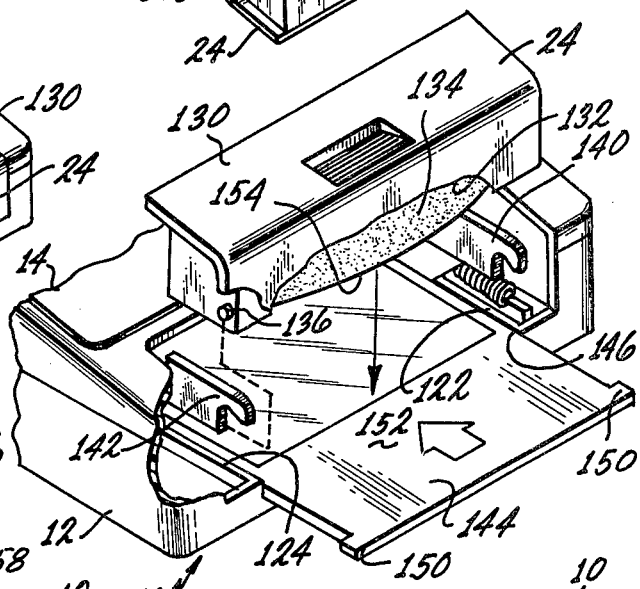
FIG. 6
FIG. 5
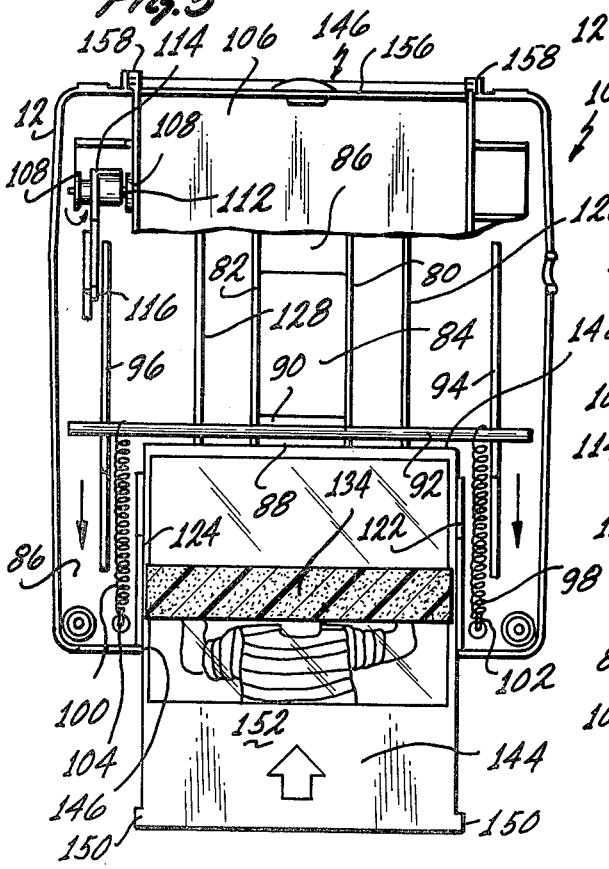
FIG. 4
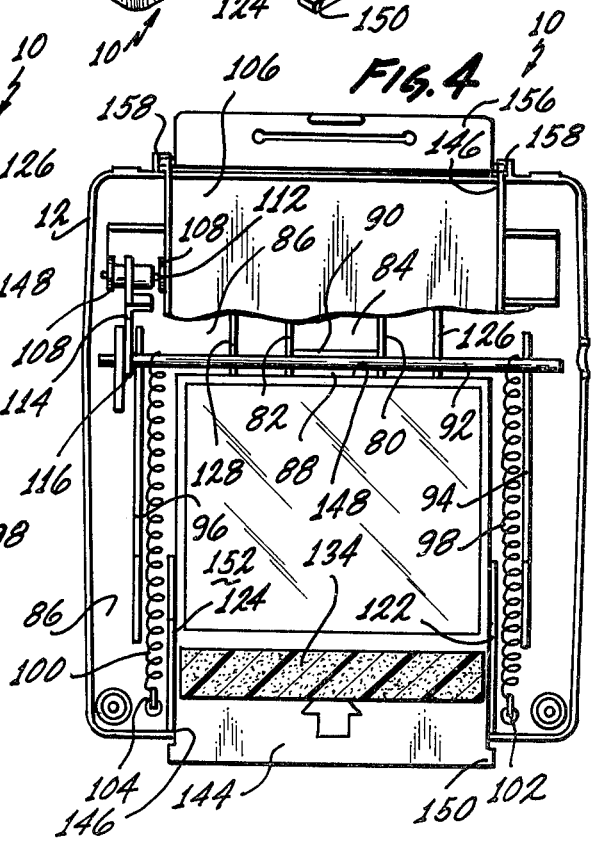

TOY CAMERA HAVING PICTURE EJECTION MECHANISM

BACKGROUND OF THE INVENTION

This invention is related to a toy camera which is capable of ejecting a plate from its interior and includes a braking mechanism which limits the force with which the plate is ejected while concurrently depositing a thin film of water on the plate.

Many toy cameras have been designed and sold which visually mimic a real camera but which unfortunately do nothing more than simply click if their shutter button is depressed. In order to more closely mimic a real camera improvements have been made in toy cameras which actually dispense a perforated roll of pictures simulating the positive picture eventually obtainable from a real camera.

Since the rolls of perforated paper used in this type of camera all have a predetermined set of designs located in a predetermined order, the child who uses such a toy camera while actually getting the effect of having a developed picture must accept whatever picture is next in line on the roll. If the child is taking a pretend picture of his friend and the picture of a landscape is next in line, of course, the realism of the picture is lacking.

An improved form of this type of toy camera is one wherein instead of a preformed roll a series of plates are used for the pictures. This type of picture mimics the typical Polaroid type picture and has the advantage of allowing the child to prearrange the order of the pictures such that the child can, for example, pretend to take the picture of a person and in effect have a preformed picture of a person actually dispensed from the toy camera.

It is considered that the above noted type camera would be improved if before insertion into the camera the preformed picture were covered or hidden such that the design on its surface was not viewable but in fact appeared to be an empty or blank piece of film. Japanese patents Nos. 49-130913 and 50-5097 describe certain membranes which can be overlaid over a picture and when these membranes are moistened with water they change from being opaque to being transparent. If the preformed picture used in a toy camera were covered with a membrane of this nature it is considered that this would add an exciting degree of realism to a child playing with a toy camera incorporating a film which only showed an image after it was dispensed from a camera.

BRIEF SUMMARY OF THE INVENTION

It is an object of this invention to provide a toy camera which is capable of dispensing a simulated piece of film which is covered with a membrane which retards viewing of the film when the membrane is dry but which allows viewing of the film when the membrane is wet. It is a further object of this invention to provide a toy which will dispense the above noted type film in a safe and sane manner. Additionally, it is an object to provide a toy which because of its simple construction and operation is durable in use and can be manufactured and sold at a reasonable cost.

Because the use of such an above noted membrane requires a means within the toy camera which is capable of dispensing a liquid film, preferably water, on the surface of a simulated picture, the camera must contain a means to both eject the film while simultaneously dispensing the fluid. It is a further object to provide a toy camera which provides for both the ejection of the film and the dispensing of the fluid in a safe and sane manner.

These and other objects which will be obvious by the remainder of this specification are achieved by providing a toy which comprises: a housing, said housing including an opening allowing ingress and egress into the interior of the housing through the opening and at least one separate flat plate member having a flat surface, said plate being capable of fitting into said opening in the housing and being retained in the housing. Located in the housing and positioned to operatively connect with the plate when the plate is inserted into the opening is an ejection means which is capable of forcefully ejecting the plate from the housing through the opening. A breaking means is positioned in the housing to bear upon the surface of the plate as the plate is ejected from the housing by the ejection means. The braking means includes a fluid reservoir capable of retaining a quantity of fluid. The braking means simultaneously retards the ejection of the plate from the opening by the ejection means and deposits a thin film of fluid on the surface of the plate as it is being ejected.

Included in the toy is a guide means which is associated with the opening in the housing and assists in locating a plate within the toy housing such that when the plate is ejected from the housing the plate is properly positioned in association with the braking means. Also included in the toy is a retaining means connected to the ejection means which is capable of maintaining the plate within the housing until a release means is activated by the operator of the toy releasing the plate from the housing at the command of the operator.

BRIEF DESCRIPTION OF THE DRAWINGS

This invention will be better understood when taken in conjunction with the drawings in which:

FIG. 1 is an oblique view of the outside housing of the invention;

FIG. 4 is a top plan view in partial section about the line 4—4 of FIG. 1;

FIG. 5 is a view similar to FIG. 4 except that certain components of the invention are arranged in a different spatial relationship with respect to one another;

FIG. 6 is an exploded oblique view of the front lowermost portion of the invention shown in FIG. 1; and FIG. 7 is an oblique view of a portion of the invention shown located on the housing in FIG. 1.

Figure 3:
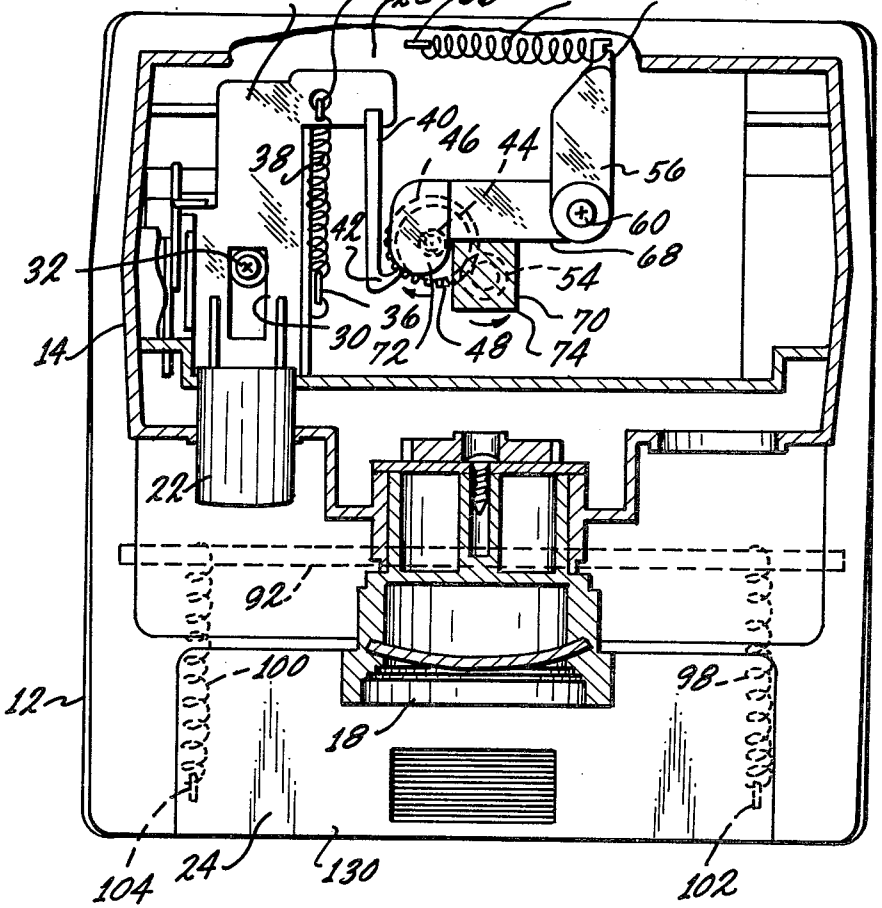
FIG. 3 is a top plan view in section about the line 3—3 of FIG. 1.
Figure 2:
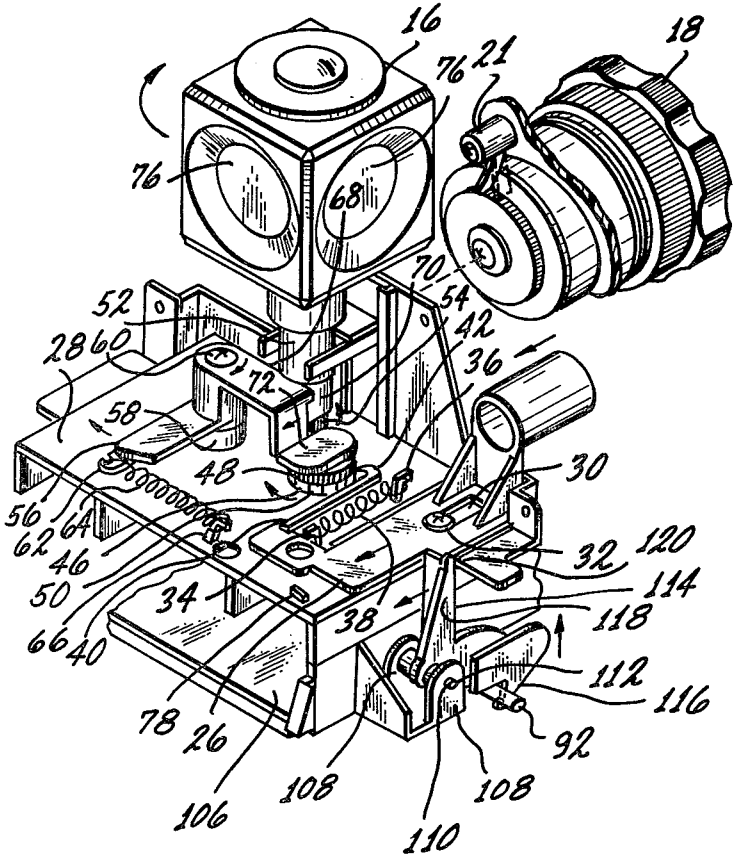
FIG. 2 is an isometric view of certain of the working components of the invention which are hidden within the housing shown in FIG. 1.

Those skilled in the art to which this invention is directed will realize that this invention employs certain principles and concepts which are set forth and defined in the claims appended to this specification. These principles and concepts will be recognized as being applicable to a number of differently appearing embodiments without deviating from the spirit and scope of the appended claims. For this reason this invention is to be construed in light of the claims and is not to be construed as being limited to the exact embodiments illustrated in the drawings and the specification.

DETAILED DESCRIPTION

The toy 10 of this invention in the shape of a camera is housed in a composite housing composed of a bottom housing section 12 and a top housing section 14. Visible from the outside surfaces of these two housing sections 12 and 14 is a rotatable flash turret 16, a combination rotatable lens and lens housing 18, a viewing window 20, a push button 22, and a removable reservoir component 24.

The viewing window 20 has a lens piece (not shown or numbered) on the backside of the top housing 14 which together with the viewing window 20 allows a user of the toy to sight toward an object much like as is done with an actual camera. The combination lens-lens housing unit 18 is rotatably mounted in the top section 14 such that it allows a user of the toy to turn the lens in a manner similar to that done with an actual camera. A clicking mechanism 21 is operatively associated with the lens which clicks as the lens is turned. The lens 18 itself has no function other than providing a cosmetic attachment to the toy 10 giving it a realistic appearance and method of operation.

The push button 22 is operatively associated with two different mechanisms and activates both of these. The first mechanism causes rotation of the flash turret 16. The push button 22 is integrally formed as part of a sliding member 26 slidably attached to internal structural housing member 28. The sliding member 26 has a slot 30 in its surface. A broad headed screw 32 passes through the slot 30 into the structural member 28 retaining the sliding member 26 on the surface of the structural member 28. Included as part of the structural member 28 is a small upstanding peg 34 having a small detent on its end. An identical peg 36 projects from the surface of structural member 28. A spring 38 is attached to both of these pegs 34 and 36 biasing the sliding member 26 toward the front of the camera causing push button 22 to extend outwardly toward the front of the camera. Integrally formed with structural member 28 is a flexible finger 40 having a detent tooth 42 on its end.

An upstanding boss 44 is integrally formed with and projects upwardly from structural member 28. Rotatably resting on boss 44 is a gear 46. The gear 46 has two sets of teeth: spur teeth 48 and ratchet teeth 50. The ratchet teeth 50 are located on the bottom of the gear 46 in a position where in detent tooth 42 can engage with them as the structural member 28 slides backward against the bias of spring 38 under the influence of the operator's finger depressing the push button 22. As the detent tooth 42 engages the ratchet teeth 50 gear 46 is rotated in a clockwise manner.

The flash turret 16 is appropriately keyed to the top of turret column 52. On the bottom of turret column 52 is a small axle (not seen or numbered) which fits into an appropriate hole (not seen or numbered) in structural member 28. This provides a bottom bearing for the turret column 52. The top bearing (not seen or numbered) for turret column 52 consists of the hole in the top housing section 14 surrounding the flash turret 16. Located near the bottom of the turret column 52 is a pinion gear 54. The pinion gear 54 meshes with the spur teeth 48 on gear 46. Thus, as gear 46 turns under the influence of detent tooth 42 the interaction of the pinion gear 54 with the spur teeth 48 causes rotation of the turret column 52 and consequently rotation of the flash turret 16.

A compound bell crank 56 is appropriately rotatably mounted to an upstanding boss 58 projecting from the surface of structural housing member 28 by a long screw 60. On one end of the bell crank 56 is a peg 62 adapted to receive and hold one end of a spring 64 such that when the other end of the spring 64 is attached to upstanding peg 66 integrally formed with structural member 28 the bell crank 56 is biased such that a portion of straight surface 68 is forcefully held against a section 70 of the turret column 52 which is square in shape. A foot section 72 on bell crank 56 fits over gear 46 and maintains it in its correct placement on boss 44.

When gear 46 is turned by detent tooth 42 its rotational movement is transferred to turret column 52 via pinion gear 54. The square section 70 of the turret column 52 turns against the straight surface 68 on bell crank 56. As this happens one of the four identical corners 74 of square section 70 is forced against the straight section 68 which causes the bell crank 56 to rotate against the bias of spring 64. The number of ratchet teeth 50 on gear 46 is chosen such that each time the push button 22 is depressed the turret column 52 will be rotated slightly more than 45 degrees. This will cause one of the four corners 74 to be moved slightly past the straight surface 68 and under the pressure of spring 64. The straight surface 68 will bear against this corner 74 until one of the straight sides of square section 70 comes to rest against the straight surface 68.

The flash turret 16 is square having simulated flash unit 76 on each one of its four sides. With each push of the push button 22 a different one of the flash units 76 will be rotated toward the front of the camera as is done in a regular operable camera using flash cubes or the like. The flexible finger 40 causes the detent tooth 42 to engage against gear 46 as the sliding member 26 slides backward. However, when the sliding member 26 slides forward under the influence of spring 38 the flexible finger 40 flexes causing the detent tooth 42 to simply slide across the ratchet teeth 50 not turning the same. A stop 78 is molded into the structural member 28 to limit the amount of slide of sliding member 26 on structural member 28.

On the inside of bottom housing 12 are a series of elongated ribs integrally formed with bottom section 12. Two of these ribs 80 and 82 form a right and left side track for ejection plate 84. The ejection plate 84 rides on the inside surface 86 of bottom housing section 12 between ribs 80 and 82 forward and backward within the toy 10. Located on and projecting upwardly from ejection plate 84 are two flanges 88 and 90 which form a seat for ejection rod 92. Ejection rod 92 near its ends slides on ribs 94 and 96. Two springs 98 and 100 are appropriately attached to pegs 102 and 104 integrally formed with and projecting upwardly from the inside surface 86 of bottom housing section 12 near the front of the toy 10. The other ends of springs 98 and 100 attach to either side of ejection rod 92 and together these springs 98 and 100 bias both ejection rod 92 and ejection plate 84 to which it is attached toward the front of the toy 10.

A guide plate 106 fits within bottom housing section 12. Portions of this guide plate 106 are shown broken away in FIGS. 4 and 5. On the left side of guide plate 106 are two ears collectively identified by the numeral 108 each having a hole 110 therein which forms a bearing for an axle 112. Mounted on the axle 112 such that it is free to swivel about axle 112 is ejection bell crank 114. One end of ejection bell crank 114 has a detent tooth 116 on it. The ejection bell crank 114 is located near the rear of the toy 10 such that it will engage with and maintain ejection rod 92 in a position toward the rear of the toy 10 against the bias of springs 98 and 100. The other end 118 of ejection bell crank 114 is located in the pathway of projection 120 which is integrally formed with sliding member 26. When push button 22 is depressed sliding the sliding member 26 the projection 120 engages end 118 of ejection bell crank 114 causing it to rotate about axle 112 such that detent tooth 116 is raised upwardly releasing its grip on ejection rod 92 allowing ejection rod 92 to forcefully slide forward under the bias of springs 98 and 100. Concurrently since ejection rod 92 rests in flanges 88 and 90 of ejection plate 84 ejection plate 84 also is forcefully slid forward with ejection rod 92.

Guide plate 106 forms the top surface of a chamber within bottom housing section 12. Ribs 122 and 124 form the side surfaces of the entrances of this chamber. Ribs 80 and 82 along with ribs 126 and 128 form bottom support members in this chamber.

The reservoir component 24 is in the form of a generally rectangular shaped housing 130 having an opening 132 on the bottom thereof. Located within the housing 130 and slightly projecting through the opening 132 is a sponge 134. Projecting from either side of housing 130 are detent pins 136 and 138. Projecting from the front of guide plate 106 are locking members 140 and 142. When the housing 130 is slid onto the toy 10 the detent pins 136 and 138 are located under and become locked in the locking members 140 and 142 holding the reservoir component 24 in correct position to the toy 10.

One of a series of flat rectangular plates 144 is insertable through an ingress-egress opening 146 formed in part by bottom housing section 12 and in part by reservoir component 24. When the plate 144 is so inserted into opening 146 it is positioned within the chamber in the toy 10 by those components forming the chamber as hereinbefore described. The back 148 of the plate 144 rests against flange 88 on ejection plate 84. The plate 144 is manually pushed into the opening 146 against the ejection plate 84 pushing the ejection plate 84 and consequently the ejection rod 92 against the bias of springs 98 and 100 until the plate 144 is almost totally located within the toy 10 at which time the ejection rod 92 engages with and is locked by detent tooth 116 on ejection bell crank 114. Two tabs collectively identified by the numeral 150 are formed on the front of each plate 144 and prevent the plate 144 from being totally inserted within the toy 10. The plate 144 is so sized that ejection rod 92 will become locked in detent tooth 116 just as the tabs 150 are proximal to the opening 146.

When the plate 144 is held within the body of toy 10 the sponge 134 is pressed against the upper surface 152 of the plate 144. Prior to inserting the plate 144 the reservoir component 24 is filled with water by inserting water through the opening 132 until the sponge 134 is saturated. When the push button 22 is depressed the flash turret 16 will turn as previously desribed. Additionally the ejection bell crank 114 is rotated freeing the ejection rod 92 from the grip of detent tooth 116. Springs 98 and 100 then forceably pull the ejection rod 92 and the ejection plate 84 forward. Since the plate 144 is abutted against flange 88 it too is pushed forward expelling it from the opening 132. The surface 154 of sponge 134 presses against the plate 144 and breaks its momentum as it is expelled out of the opening 132. Concurrently with breaking the momentum of plate 144 water from within the interior of sponge 134 is deposited as a thin film on the upper surface 152 of plate 144 by the surface 154 of sponge 134.

The limit of travel of ejection rod 92 is governed when ejection rod 92 comes in contact with the ends of ribs 122 and 124. At this time a portion of plate 144 is still located within the toy 10 being held there by the surface 154 of sponge 134. The operator of the toy then manually retracts the plate 144 completely from the opening 132.

The plate 144 in the preferred embodiment of the invention illustrated in the drawings is in a form that mimics a self-developing picture of the "Polaroid" type. It can take one of several forms such that when it is ejected from the toy camera 10 it will appear as an already developed instant picture. Preferably, however, the plate 144 will contain a picture which is overlaid with a water sensitive membrane such that when it is ejected from the toy 10 the sponge 134 will deposit a thin film of water on its surface and this thin film of water will interact with the membrane overlaying the picture causing the membrane to change from an opaque membrane to a transparent membrane allowing viewing of the picture located below the membrane.

Membranes of this type are described in Japanese patent Nos. 49-130913 and 50-5097, the disclosures of which are herein incorporated by reference. By incorporating an inorganic compound such as magnesium carbonate, calcium carbonate, or natural silica clay with an organic compound such as casein, synthetic latex, vinyl acetate or acryllic ester a membrane can be prepared which is opaque when dry but transparent when wet.

In the preferred form the plate 144 would consist of a flat plastic backing with a picture glued to its surface and a membrane chosen from the group above overlaid on the picture. After being ejected from the toy camera 10 the membrane retains moisture for a period sufficient for a child to enjoy the picture. However, when the plate 144 is set aside and allowed to dry the moisture evaporates from the membrane rendering it opaque again allowing the child to reuse the plate to take another picture.

Normally a series of pictures having a comic appearance would be used with the camera and a child could surprise one of his friends or family by pretending to take their picture and then showing them the comic picture ejected from the toy camera 10. The toy camera 10 also includes a door 156 hinged to two ears both collectively identified by the numeral 158 formed on the rear-most portion of guide plate 106. The area on top of guide plate 106 within the top section 14 forms a storage compartment for one or more of the plates 144 when they are not in use in the simulated picture taking operation of the camera.

I claim:

1. A toy which comprises:

a housing;

said housing including an opening allowing ingress and egress to the interior of said housing through said opening;

a plate member having a flat surface, at least a portion of said plate member capable of fitting into said opening in said housing and being retained in said housing;

an ejection means located in said housing and positioned within said housing to operatively interact with said plate when said plate is inserted through said opening into said housing and to be capable of ejecting said plate from said housing through said opening;

a braking means positioned in said housing to bear upon the surface of said plate member as said plate member is ejected from said housing by said ejection means, said braking means including a fluid reservoir means capable of retaining a quantity of fluid and a braking surface means operatively connected to said fluid reservoir means, said braking surface means capable of retarding the ejection of said plate through said opening and depositing a thin film of said fluid on the surface of said plate.

2. The toy of claim 1 wherein:

said ejection means includes guide means located in said housing and operatively associated with said opening such that when said plate is inserted into said opening in said housing said plate is guided by said guide means into said housing and said plate is retained in operative association with said braking means.

3. A toy which comprises:

a housing;

said housing including an opening allowing ingress and egress to the interior of said housing through said opening;

a plate member having a flat surface, at least a portion of said plate member capable of fitting into said opening in said housing and being retained in said housing;

an ejection means located in said housing and positioned within said housing to operatively interact with said plate when said plate is inserted through said opening into said housing and to be capable of ejecting said plate from said housing through said opening;

a braking means positioned in said housing to bear upon the surface of said plate member as said plate member is ejected from said housing by said ejection means, said braking means including a fluid reservoir means capable of retaining a quantity of fluid and a braking surface means operatively connected to said fluid reservoir means, said braking surface means capable of retarding the ejection of said plate through said opening and depositing a thin film of said fluid on the surface of said plate;

said ejection means including guide means located in said housing and operatively associated with said opening such that when said plate is inserted into said opening in said housing said plate is guided by said guide means into said housing and said plate is retained in operative association with said braking means;

a retaining means located in said housing, said retaining means operatively connected to said ejection means and capable of holding said ejection means in an activated position when said plate is located within said opening in said housing and including a release means for releasing said ejection means such that said ejection means is capable of ejecting said plate from said housing.

4. The toy of claim 3 wherein:

said braking means includes a material having sponge-like qualities, said braking surface means includes the surface of said material having sponge-like qualities, and said fluid reservoir means includes pores within said material having sponge-like qualities, said pores interconnecting with each other to channel fluid from said pores to said surface.

5. The toy of claim 4 wherein:

said braking means includes a reservoir-housing, said reservoir-housing including an orifice, said material having sponge-like properties fitting within said reservoir-housing such that a portion of said material having sponge-like qualities projects through said orifice.

6. The toy of claim 5 wherein:

said ejection means includes an ejection rod movable within said housing along an axis passing through said opening, a biasing means connecting to said ejection rod and biasing said ejection rod toward said opening.

7. The toy of claim 5 wherein:

said guide means includes a plurality of ribs located in said housing and positioned to fit around the outside of said plate member when said plate member is inserted into said opening,

8. The toy of claim 7 wherein:

said retaining means includes a rotatable member rotatably mounted in said housing in operative association with said ejection rod, said rotatable member capable of reversably holding said ejection rod against the bias of said biasing means.

9. The toy of claim 8 wherein:

said release means includes a button, a portion of which projects out of said housing, and a linking member slidably mounted within said housing and positioned to transfer movement of said button to said rotatable member.

10. The toy of claim 9 wherein:

said plate member includes an indicia located on said flat surface.

* * * * *